United States Patent [19]

Morera et al.

[11] Patent Number: 4,602,390

[45] Date of Patent: Jul. 29, 1986

[54] INDEPENDENT POCKET FOR INCORPORATING INTO ANY KIND OF CLOTHING

[76] Inventors: Ignacio G. Morera, Licenciado Poza, 60; Francisco T. Antuñano, Telesforo Aranzadi, 1, both of Bilbao, Spain

[21] Appl. No.: 739,157

[22] Filed: May 30, 1985

[30] Foreign Application Priority Data

May 31, 1984 [ES] Spain ..... 279613

[51] Int. Cl.[4] ..... A47D 27/20

[52] U.S. Cl. ..... 2/251; 2/247

[58] Field of Search ..... 2/247, 248, 249, 250, 2/251

[56] References Cited

U.S. PATENT DOCUMENTS 2,557,445 6/1951 Lewallen ..... 2/247

4,266,300 5/1981 Partridge ..... 2/247

FOREIGN PATENT DOCUMENTS 1509104 12/1967 France ..... 2/247

1257707 12/1971 United Kingdom ..... 2/247

*Primary Examiner*—Doris L. Troutman

*Attorney, Agent, or Firm*—Lucas & Just

[57] ABSTRACT

An independent pocket for incorporating into any kind of clothing perculiar inasmuch that it is comprised of:

(a) At least two layers of material which are joined together;

(b) Means of attachment between at least one of said layers of material and the article of clothing where it is positioned.

(c) Means of opening and closing the pocket thus formed which are located on one of said layers and/or on the joining edge between them.

12 Claims, 6 Drawing Figures

INDEPENDENT POCKET FOR INCORPORATING INTO ANY KIND OF CLOTHING

Pieces of clothing that possess pockets are at present known, but these pockets are formed all in one with the article of clothing, and cannot be separated therefrom.

The purpose here is therefore to achieve a pocket that is separate from such article of clothing, but which possesses all the features of a pocket that is in no way separable from its piece of clothing.

This pocket in the invention here is attachable to any kind of clothing and to any part of same, while it is characterised because it comprises:

(a) At least two layers of material which are joined together;

(b) Means of attachment between at least one of said layers of material and the article of clothing where it is positioned.

(c) Means of opening and closing the pocket thus formed which are located on one of said layers and/or on the joining edge between them.

In accordance with one characteristic of the invention, the two layers of material which are joined together offer the same area and/or geometrical shape.

In accordance with another characteristic of the invention, the two layers of material which are joined together offer different areas and/or geometrical shapes.

In accordance with another characteristic of the invention, the attachment between the pocket and the article of clothing is accomplished by means of a heat sensitive adhesive layer which takes up part of or the whole of that one of the two layers of material which is positioned furthest back, it being secured thereto and to the article of clothing by the application of heat.

In accordance with another characteristic of the invention, the attachment between the pocket and the article of clothing is accomplished by a self-adhesive layer which takes up part of or the whole of that one of the two layers of material which is positioned furthest back and is adhered to the article of clothing.

In accordance with another characteristic of the invention, the attachment between the pocket and the article of clothing is accomplished by two strips of velvet or similar material which being place opposite one another on the article of clothing and on one of the layers of material on the pocket respectively, become joined together.

In accordance with yet another characteristic of the invention, the attachment between the pocket and the article of clothing is accomplished by sewing, stapling or similar means.

In accordance with another characteristic of the invention, the means for opening and closing the pocket consist of a zip fastener located on that one of the two layers of material which is positioned furthest forward, or on the joining edge between said two layers.

In accordance with another characteristic of the invention, the means for opening and closing the pocket comprise two strips of velvet or similar material placed upon one of the joining edges between the layers of materials.

In accordance with another characteristic of the invention, the means for opening and closing the pocket comprise an overlapping edge on one of the layers of material, and this is superimposed upon the other layer of material and attached thereto by means of buttons, zip fastener, velvet strips or similar.

In accordance with another characteristic of the invention, the overlap extends from one of the layers of material and is superimposed upon itself.

In accordance with another characteristic of the invention, the mouth of the pocket, being provided with means for opening and closing, takes up part of the total width of one of the layers of material, or the joining edge between said layers.

In accordance with another characteristic of the invention, the mouth of the pocket, being provided with means for opening and closing, takes up the whole width of one of the layers of material, in which case this is comprised of two halves.

In accordance with another characteristic of the invention, the mouth of the pocket is arranged in the horizontal position.

In accordance with another characteristic of the invention, the mouth of the pocket is arranged in the vertical position.

In accordance with another characteristic of the invention, the mouth of the pocket is arranged to slope at an angle upon that one of the two layers of material which is positioned furthest forward.

The present invention is concerned with a separate pocket which is capable of being embodied upon any kind of article of clothing, and which comprises:

a first layer of material (1), which is positioned towards the front, a second layer of material (2), which is positioned towards the rear, means of attachment (3) between said rearmost layer of material (2) and the article of clothing upon which the pocket is placed, means of opening and closing (11) the pocket thus formed.

Figure 1:
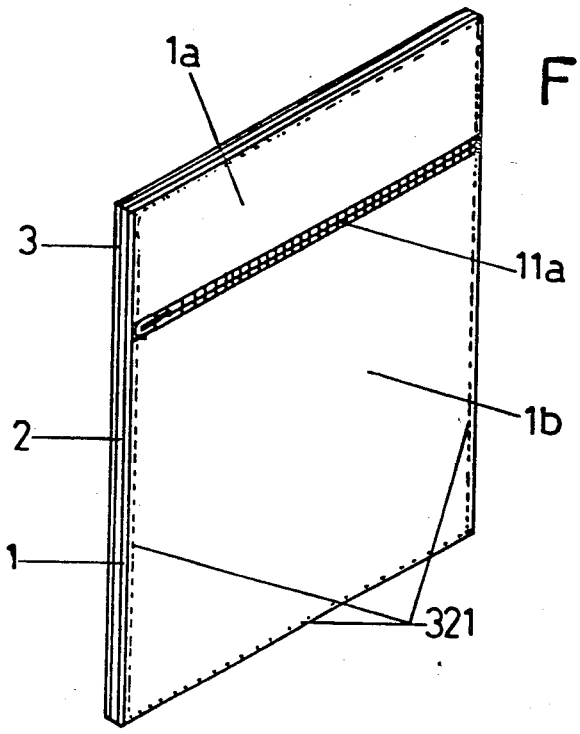
FIG. 1 is a general isometric view of the pocket covered by this invention showing all the pieces and parts that comprise it, and where layers of material (1) and (2) possess the same area and/or geometrical shape.

Layers of material (1) and (2) are joined together along the whole or part of their perimeter (321) and may possess either identical (see FIG. 1) or differing (see FIG. 2) geometrical shapes.

The means of attachment (3) between one of the layers of material (2) and the article of clothing (not shown) to which the pocket is attached, take up part (see FIGS. 2 and 3) or all (see FIGS. 1 and 4) of the front face of the relevant layer of material (2).

While these do in no way alter the essential features of the invention, and by way of examples for guidance which in no way are limitative, specific means for attachment (3) are now quoted: a self-adhesive layer; a heat-adhesive layer; two strips of velvet or similar, placed one upon the layer of material (2), and one upon the article of clothing (not shown); or by means of sewing, stapling or the like.

Figure 2:
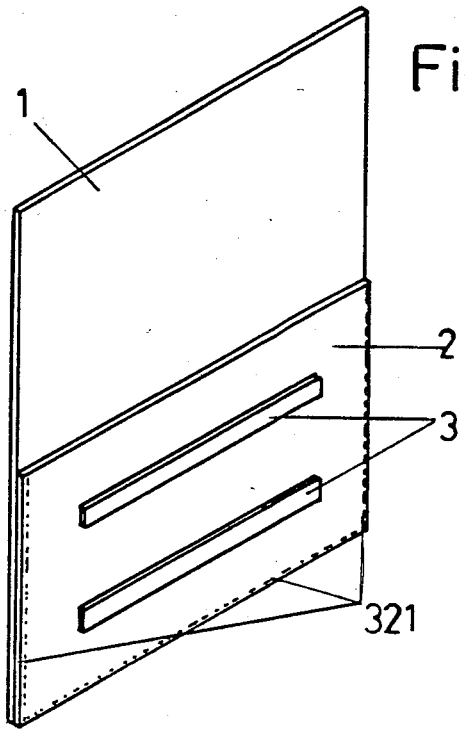
FIG. 2 depicts a similar view to FIG. 1, but here it is the opposite way around, and layers of material (1) and (2) possess differing areas and/or geometrical shapes.
Figure 5:
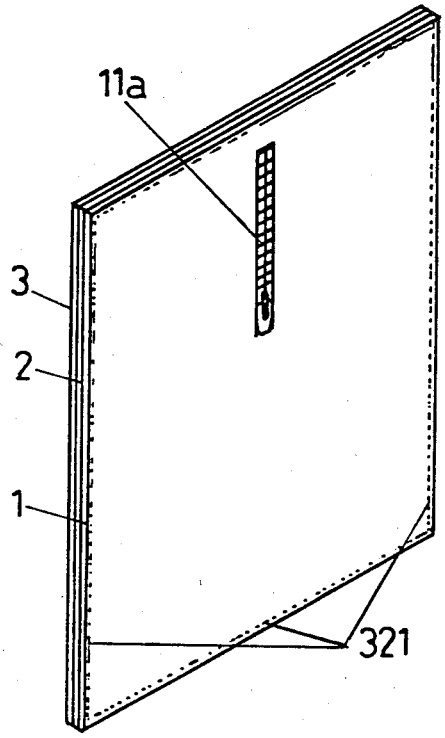
FIG. 5 is a similar view to that depicted in the above mentioned figures, and here the mouth of the pocket, being arranged in the vertical position, takes up part of the width of one of the layers of material (1).
Figure 3:
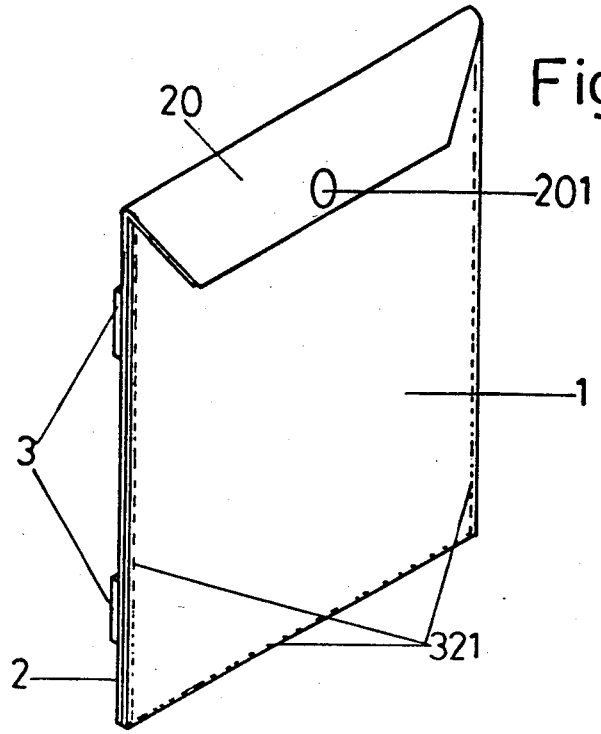
FIG. 3 is a similar view to the aforementioned, and here layer of material (2) extends into an overlap (20) that is superimposed on the other layer of material (1) and capable of being attached thereto.
Figure 6:
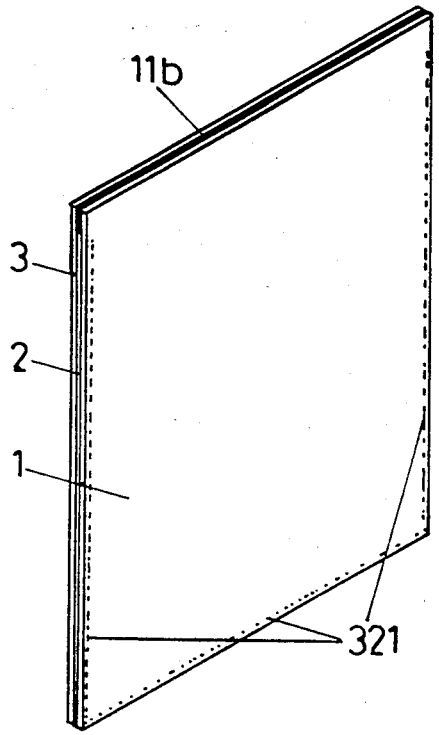
FIG. 6 is a similar view to the aforegoing ones, and here the opening and closing means (11) are located upon the upper edge.

The means for opening and closing (11) the pocket are positioned either upon that one of the layers of material (1) which is positioned furthest forward (see FIGS. 1, 4 and 5), or upon one of the edges between the layers (1), (2), (see FIGS. 2, 3 and 6).

Without in any way altering the essential features of the invention, the position of the mouth of the pocket which embodies means of closing (11) can be either horizontal, vertical or sloping, and may likewise take up the whole or part of the width of the relevant layer of material (1). In the event of its taking up the whole of said width, the layer of material may be regarded as being sub-divided into two halves (la) and (1*b*), (see FIGS. 1 and 4).

Figure 4:
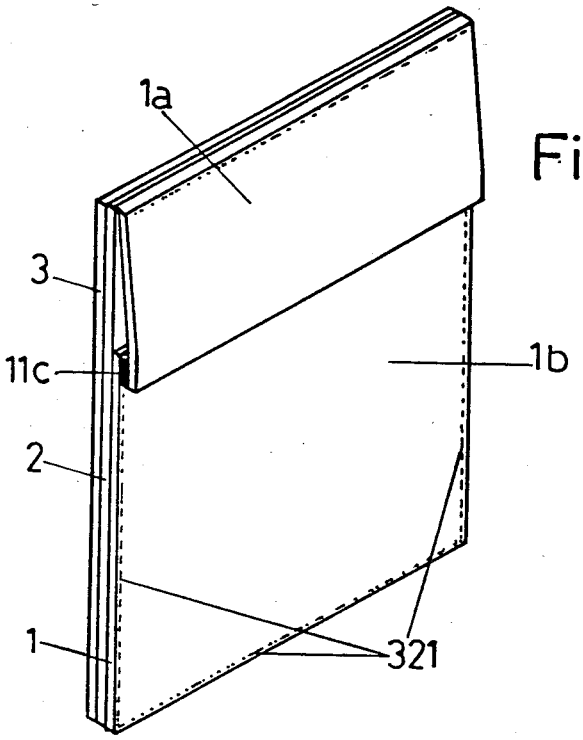
FIG. 4 depicts a similar view to the aforegoing, but here overlap (20) is extended from one of the layers of material (1) and is superimposed thereupon.

Without in any way altering the essential features of the invention, and by way of purely explanatory and non-limitative example, specific means of closing (11) are now quoted: a zip fastener (11*a*), (see FIG. 1); a piece of velvet or similar (11*b*), (See FIG. 6); an overlap (20) extending from one of the layers of material (2), superimposed upon the other (1) and being closed by means of a bottom (201) or similar (see FIG. 3); an overlap (10) extending from one half of layer of material (1*b*), superimposed upon itself on the other half (1*a*), and capable of being closed or sealed by means of a strip of velvet (11*c*) or similar (Figure 4).

We claim:

1. An independent pocket for incorporating into any kind of clothing which comprises:

(a) at least two layers of material which are joined together;

(b) a heat sensitive adhesive layer which takes up part of or the whole of one of the two layers of material which is positioned furtherst back, said heat sensitive adhesive layer being secured thereto and to the article of clothing by the application of heat; and (c) means of opening and closing the pocket thus formed which are located on one of said layers and/or on the joining edge between them.

2. An independent pocket for incorporating into any kind of clothing, in full accordance with the first claim above and peculiar wherewith the two layers of material which are joined together offer the same area or geographical shape.

3. An independent pocket for incorporating into any kind of clothing in full accordance with the first claim above and peculiar wherewith the two layers of material which are joined together offer different areas and/or geometrical shapes.

4. An independent pocket for incorporating into dry kind of clothing in full accordance with the claim 1 and peculiar insofar that the means for opening and closing the pocket consist of a zip fastener located on that one of the two layers of material which is positioned furthest forward, or on the joining edge between said two layers 5. An independent pocket for incorporating into any kind of clothing in full accordance with claim 1 above and peculiar insofar that the means for opening and closing the pocket comprise two strips of velvet or similar material placed upon one of the joining edges between the layers of materials.

6. An independent pocket for incorporating into any kind of clothing in full accordance with claim 1 above and peculiar wherewith the means for opening and closing the pocket comprise an overlapping edge on one of the layers of material, and this is superimposed upon the other layer of material and attached thereto by means of buttons, zip fastener, velvet strips or similar.

7. An independent pocket for incorporating into any kind of clothing in full accordance with the tenth claim above and peculiar insofar that the overlap extends from one of the layers of material and is superimposed upon itself.

8. An independent pocket for incorporating into any kind of clothing in full accordance with the claim 1 and peculiar wherewith the mouth of the pocket, being provided with means for opening and closing, takes up part of the total width of one of the layers of material, or the joining edge between said layers.

9. An independent pocket for incorporating into any kind of clothing in full accordance with the claim 1 and peculiar insofar that the mouth of the pocket, being provided with means for opening and closing, takes up the whole width of one of the layers of material, in which case this is comprised of two halves.

10. An independent pocket for incorporating into any kind of clothing in full accordance with the claim 1 and peculiar insofar that the mouth of the pocket is arranged in the horizontal position.

11. An independent pocket for incorporating into any kind of clothing in full accordance with claim 1 above and peculiar inasmuch that the mouth of the pocket is arranged in the vertical position.

12. An independent pocket for incorporating into any kind of clothing in full accordance with the claim 1 and peculiar insofar that the mouth of the pocket is arranged to slope at an angle upon that one of the two layers of material which is positioned furthest forward.

* * * * *